US008709209B2

(12) United States Patent
Li et al.

(10) Patent No.: US 8,709,209 B2
(45) Date of Patent: Apr. 29, 2014

(54) ANIONIC LIPOPHILIC GLYCEROL-BASED POLYMERS FOR ORGANIC DEPOSITION CONTROL IN PAPERMAKING PROCESSES

(71) Applicants: Xiaojin Harry Li, Palatine, IL (US); Paul Richardson, Pittsburgh, PA (US); Qing Qing Yuan, Shanghai (CN); Qun Dong, Shanghai (CN)

(72) Inventors: Xiaojin Harry Li, Palatine, IL (US); Paul Richardson, Pittsburgh, PA (US); Qing Qing Yuan, Shanghai (CN); Qun Dong, Shanghai (CN)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 13/730,003

(22) Filed: Dec. 28, 2012

(65) Prior Publication Data

US 2013/0340964 A1 Dec. 26, 2013

Related U.S. Application Data

(63) Continuation-in-part of application No. 13/560,771, filed on Jul. 27, 2012, and a continuation-in-part of application No. 12/720,973, filed on Mar. 10, 2010, now Pat. No. 8,366,877.

(51) Int. Cl.

| | |
|---|---|
| ***D21C 9/08*** | (2006.01) |
| ***D21H 17/53*** | (2006.01) |
| ***D21H 21/02*** | (2006.01) |
| ***D21H 23/04*** | (2006.01) |
| ***C07C 43/18*** | (2006.01) |
| ***C08G 65/00*** | (2006.01) |

(52) U.S. Cl.

USPC ..... 162/164.7; 162/158; 162/164.1; 162/175; 162/185; 568/679

(58) Field of Classification Search

USPC ..... 162/158, 164.7, 164.1, 175, 183; 568/579, 672, 678–680

See application file for complete search history.

(56) References Cited

U.S. PATENT DOCUMENTS

| | | | | |
|---|---|---|---|---|
| 5,429,718 | A * | 7/1995 | Morlino et al. | 162/72 |
| 6,620,904 | B2 * | 9/2003 | Lemke | 528/295.5 |
| 8,101,045 | B2 * | 1/2012 | Furman et al. | 162/112 |
| 8,366,877 | B2 * | 2/2013 | Duggirala et al. | 162/72 |
| 2003/0124710 | A1 * | 7/2003 | Borch et al. | 435/262 |
| 2010/0212847 | A1 * | 8/2010 | Hamers et al. | 162/75 |
| 2011/0092743 | A1 * | 4/2011 | Li et al. | 568/679 |

* cited by examiner

*Primary Examiner* — Dennis Cordray

(74) *Attorney, Agent, or Firm* — Benjamin E. Carlsen

(57) ABSTRACT

The invention is directed to methods and compositions for reducing the deposition of pitches and stickies in a papermaking process. The method involves introducing an anionic glycerol-based polymer to the papermaking process. This anionic polymer prevents the pitches and stickies from depositing and agglomerating in papermaking processes.

16 Claims, 3 Drawing Sheets

ANIONIC LIPOPHILIC GLYCEROL-BASED POLYMERS FOR ORGANIC DEPOSITION CONTROL IN PAPERMAKING PROCESSES

CROSS-REFERENCE TO RELATED APPLICATIONS

This application is a Continuation-in-part of co-pending U.S. patent application Ser. No. 13/560,771 filed on Jul. 27, 2012 and of U.S. patent application Ser. No. 12/720,973 filed on Mar. 10, 2010 now U.S. Pat. No. 8,366,877.

STATEMENT REGARDING FEDERALLY SPONSORED RESEARCH OR DEVELOPMENT

Not Applicable.

BACKGROUND OF THE INVENTION

This invention relates to methods of reducing the deposition of organic contaminants, such as pitch and stickies, in papermaking processes. The deposition of organic contaminants on process equipment, screens, and containment vessels in papermaking can significantly reduce process efficiency and paper quality. Deposits on machine wires, felts, foils, headbox surfaces, screens, and instruments can result in costly downtime for cleaning to avoid the problems associated with poor process control, reduced throughput, and substandard sheet properties. Such contaminants are generically referred to in the paper industry as either "pitch" or "stickies". Pitch deposits generally originate from natural resins present in virgin pulp, including terpene hydrocarbons, rosin/fatty acids or salts thereof, such as pimaric acid, pinic acid and abietic acid, glyceryl esters of fatty acid, sterols, etc. Stickies and white pitch generally refer to the hydrophobic substances used in the manufacture of paper such as sizing agents, coating binders, and pressure sensitive or contact adhesives. Such substances can form deposits when reintroduced in recycled fiber systems. Other common organic contaminants that are chemically similar to stickies and found in recycle applications include wax, which originates primarily from wax-coated old corrugated containers, and polyisoprene. Pitch and stickies may also contain entrapped inorganic materials such as talc, calcium carbonate, or titanium dioxide.

Recycled fiber also refers to secondary fibers which are repulped to provide the papermaking furnish with raw material for the production of new papers. The secondary fibers may be either pre-consumer or post-consumer paper material that is suitable for use in the production of paper products. Sources of secondary fiber may include old newspaper (ONP), old corrugated containers (OCC), mixed office waste (MOW), computer printout (CPO), ledger, etc. These once-processed papers contain various types of adhesives (pressure sensitive, hot melts, etc.), inks, and coating binders.

Pitch and stickies are hydrophobic in nature and thus unstable as colloids in aqueous papermaking environments, thereby facilitating their deposition. The major problems arising from deposition are as follows: (1) reduced throughput due to plugging of forming fabrics and press felts, (2) sheet holes or paper breaks due to large deposits breaking loose from the equipment, and (3) reduced sheet quality due to large particle contaminants incorporated in the final sheet.

One approach used to address pitch and stickies deposition is through the use of detackifiers. Detackifiers passivate the exposed surfaces of pitch and sticky particles rendering them non-adhesive and unlikely to deposit. A number of chemical are known to be effective detackifiers. Effective organic detackifiers include polyvinyl alcohol, copolymer of vinyl alcohol and vinyl acetate, polyethylene oxide, polyacrylates, and waterborne globulins. In order for detackifiers to function well, it must satisfy two crucial functions: 1) it must selectively and sufficiently attach to the surface of the pitch or sticky surface, and 2) it must stabilize the resulting sticky/pitch-detackifier complex in water.

The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of reducing the deposition of organic contaminants in papermaking processes. The method comprises adding to pulp or a papermaking system an effective amount of a composition comprising an anionic lipophilic branched, cyclic glycerol-based polymer, wherein the composition selectively bonds with the organic contaminants to form a complex and the complex is stable in papermaking processes.

The anionic group may be one selected from the list consisting of phosphates, phosphonates, carboxylates, sulfonates, the like and any combination thereof. The glycerol-based polymer may be an anionic lipohydrophilic glycerol based polymer. The glycerol-based polymer may be branched, hyperbranched, dendritic, cyclic or any combination thereof. The branched, cyclic glycerol-based polymer may be cross-linked. The anionic branched, cyclic glycerol-based polymer may comprise a random arrangement of the monomeric units including $R_1$ indicated in the following formula:

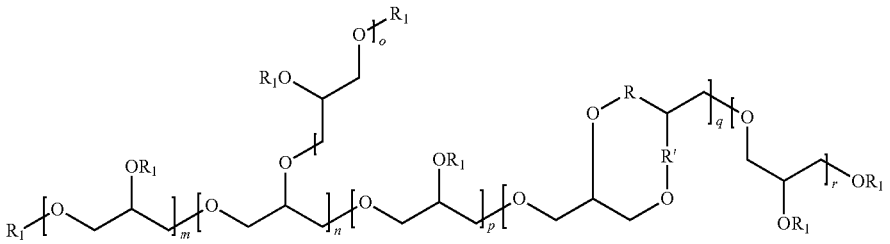

wherein:

m, n, o, p, q and r are independently 0 to 700;

R and R' are independently —$(CH_2)_x$—, wherein each x is independently 0 or 1; and each $R_1$ is independently selected from hydrogen, acyl, $C_1$-$C_{50}$ alkyl and anionic groups.

Each $R_1$ may be independently selected from hydrogen, $C_2$-$C_{18}$ alkyl, and —C(O)CH(OH)$CH_3$. Each of m, n, o, p, q and r may be independently selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50. The glycerol-based polymer has a weight-average molecular weight of about 200 Da to about 500,000 Da.

The method may further comprise adding to the pulp or the papermaking system at least one component selected from the group consisting of fixatives, dispersants, and other detackifiers. The organic contaminants may be pitch, stickies or combination thereof. The composition may be added to a pulp slurry in a pulper, latency chest, reject refiner chest, disk filter or Decker feed or accept, whitewater system, pulp stock storage chest, blend chest, machine chest, headbox, saveall chest, or any combination thereof in the papermaking process.

The composition may be added to a surface in the papermaking process selected from a pipe wall, a chest wall, a machine wire, a press roll, a felt, a foil, an Uhle box, a dryer, or any combination thereof. The anionic branched, cyclic glycerol-based polymer may be added to a pulp slurry in the papermaking process. The effective amount of the anionic branched, cyclic glycerol-based polymer may be from about 5 ppm to about 300 ppm.

BRIEF DESCRIPTION OF THE DRAWINGS

A detailed description of the invention is hereafter described with specific reference being made to the drawings in which.

DETAILED DESCRIPTION OF THE INVENTION

Figure 1:
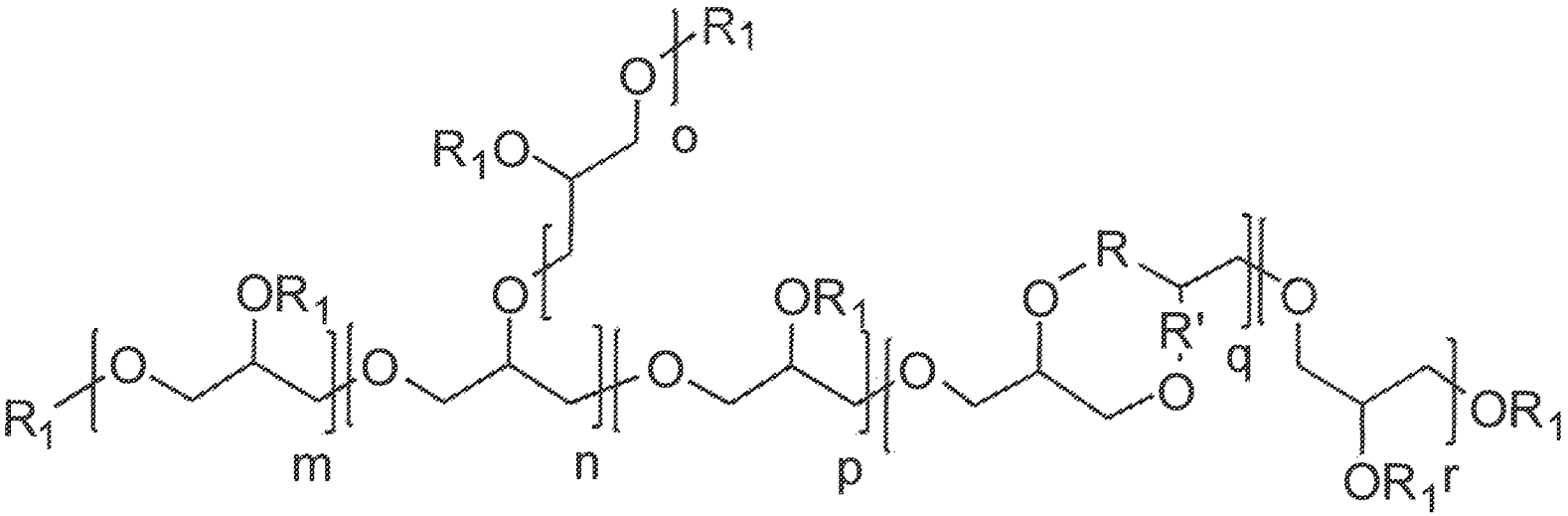
FIG. 1 is an illustration of an anionic glycerol based polymer used in the invention.

The following definitions are provided to determine how terms used in this application, and in particular how the claims, are to be construed. The organization of the definitions is for convenience only and is not intended to limit any of the definitions to any particular category.

"Acyl" as used herein refers to a substituent having the general formula —C(O)R, wherein R is alkyl, alkenyl, alkynyl, aryl, heteroaryl or heterocyclyl, any of which may be further substituted "Alkyl" as used herein refers a linear, branched, or cyclic saturated hydrocarbon group, such as a methyl group, ethyl group, n-propyl group, isopropyl group, n-butyl group, isobutyl group, tert-butyl group, n-pentyl group, isopentyl group, n-hexyl group, isohexyl group, cyclopentyl group, cyclohexyl group, and the like. Alkyl groups may be optionally substituted.

"Branched" means a polymer having branch points that connect three or more chain segments. The degree of branching may be determined by $^{13}C$ NMR based on a known literature method described in *Macromolecules,* 1999, 32, 4240. As used herein, a branched polymer includes hyperbranched and dendritic polymers.

"Cyclic" means a polymer having cyclic or ring structures. The cyclic structure units can be formed by intramolecular cyclization or any other ways.

"Degree of branching" or DB means the mole fraction of monomer units at the base of a chain branching away from the main polymer chain relative to a perfectly branched dendrimer, determined by $^{13}C$ NMR based on a known literature method described in *Macromolecules,* 1999, 32, 4240. Cyclic units or branched alkyl chains derived from fatty alcohols or fatty acids are not included in the degree of branching. In a perfect dendrimer the DB is 1 (or 100%).

"Degree of cyclization" or DC means the mole fraction of cyclic structure units relative to the total monomer units in a polymer. The cyclic structure units can be formed by intramolecular cyclization of the polyols or any other ways to incorporate in the polyols. The cyclic structure units comprise basic structure units (V, VI and VII of FIG. 2) and the analogues thereof. The degree of cyclization may be determined by $^{13}C$ NMR.

"Glycerol-based polymers" refers to any polymers containing repeating glycerol monomer units such as polyglycerols, polyglycerol derivatives, and a polymer consisting of glycerol monomer units and at least another monomer units to other multiple monomers units regardless of the sequence of monomers unit arrangements, glycerol-based polymers include but are not limited to alkylated, branched, cyclic polyglycerol esters, as well as those polymers disclosed in U.S. patent application Ser. Nos. 13/484,526, 12/720,973, and 12/582,827.

"Hyperbranched" means a polymer, which is highly branched with three-dimensional tree-like structures or dendritic architecture.

"Lipohydrophilic glycerol-based polymers" means glycerol-based polymers having lipophilic and hydrophilic functionalities, for example, lipohydrophilic polyglycerols resulting from lipophilic modification of polyglycerols (hydrophilic) in which at least a part of and up to all of the lipophilic character of the polymer results from a lipophilic carbon bearing group engaged to the polymer, the lipophilic modification being one such as alkylation, and esterification modifications.

"Mulifunctional" means a composition of matter having two or more functions such as selectively bonding to and forming a complex with a material and maintaining the stability of that complex in water.

"Papermaking process" means a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art. The papermaking process may also include a pulping stage, i.e. making pulp from a lignocellulosic raw material and bleaching stage, i.e. chemical treatment of the pulp for brightness improvement.

"Substituted" as used herein may mean that any at least one hydrogen on the designated atom or group is replaced with another group provided that the designated atom's normal valence is not exceeded. For example, when the substituent is oxo (i.e., =O), then two hydrogens on the atom are replaced. Combinations of substituents and/or variables are permissible provided that the substitutions do not significantly adversely affect synthesis or use of the compound.

"Surfactanf" is a broad term which includes anionic, nonionic, cationic, and zwitterionic surfactants. Enabling descriptions of surfactants are stated in *Kirk-Othmer, Encyclopedia of Chemical Technology*, Third Edition, volume 8, pages 900-912, and in *McCutcheon's Emulsifiers and Detergents*, both of which are incorporated herein by reference.

"Detackifiers" means a process chemical that reduces tackiness other substances present in a papermaking process or which disperses otherwise undispersed tacky substances present in a papermaking process, when detackifiers reduce the tackiness of or disperse pitch and stickies, the pitch and stickies have less tendency to form agglomerates or deposit onto papermaking equipment or create spots or holes in the product.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition (2005) (Published by Wiley, John & Sons, Inc.) this definition shall control how the term is to be defined in the claims.

In at least one embodiment of the invention, deposition of pitch or stickies in papermaking process water is controlled by the addition of a novel detackifier composition into the process water. The composition comprises an anionic lipophilic glycerol based polymer. The polymer comprises a glycerol based polymer backbone which has undergone chemical modification with multi-functional groups.

In at least one embodiment the chemical modification of glycerol-based polymers is done with an anionic group and a lipophilic group. The lipophilic group can be an aliphatic and/or aromatic hydrocarbon of 1 to 50 carbon atoms. The anionic group can be selected from the list consisting of: phosphates, phosphonates, carboxylates, sulfonates, the like including acid and/or ionic salt forms and any combination thereof. The anionic charge density can bel % to 99%.

In at least one embodiment the anionic modification of glycerol-based polymers is phosphorylation. A representative example of such phosphorylation is described in U.S. Pat. No. 3,580,855. In at least on embodiment the anionic modification is phosphonation. A representative example of such phosphonation is described in the scientific paper: *Michael Additions to Activated Vinylphosphonates*, by Tomasz Janecki et al., *Synthesis, issue* 8, pp. 1227-1254 (2009). In at least one embodiment the anionic modification is carboxyalkylation. Representative examples of such carboxyalkylation are described in US Patent Applications 2004/0018948A1 and 2006/0047168A1. In at least one embodiment the anionic modification is sulfonation. A representative example of such sulfonation is described in GB Patent Specification 802325A.

In at least one embodiment the lipophilic modification glycerol-based polymers is via alkylation, alkoxylation, oxyalkylation, esterification or any combination thereof, such as described in U.S. patent application Ser. Nos. 13/560,771, 13/484,526, 12/720,973 and references therein.

In at least one embodiment the anionic and lipophilic modifications of glycerol-based polymers are done together in one step, separately in two steps or combination thereof.

In at least one embodiment the lipophilic modification enhances the hydrophobic interaction between pitch/stickies and the anionic glycerol-based polymers. In at least one embodiment the anionic functionality enhances the water solubility for dispersing of the pitch/stickies. In at least one embodiment the anionic functionality chelates cationic ions commonly existed in water such as calcium and magnesium to increase the glass transition temperature of the pitch/stickies for preventing from being sticky in the papermaking processes.

In at least one embodiment the well-balanced modifications synergistically enhance the organic deposition control.

In at least one embodiment the backbone of anionic lipophilic glycerol-based polymers is branched, cyclic glycerol based polymer, such as described in US Patent Application 2011/0092743A1. Without being limited as to theory the lipophilic groups may interact with hydrophobic contaminants in a papermaking process, e.g., in a pulp slurry. The hydrophilic portion may aid dispersing the hydrophilic contaminants in water. The lipophilic groups may be introduced via known methods such as alkylation, alkoxylation esterification, or combinations thereof. In at least one embodiment, at least one portion of the glycerol-based polymer has both alkyl and ester functionalities. The nature of different polarities from both functionalities may be adjusted to optimally perform in dispersing pitch and stickies.

In at least one embodiment the glycerol-based polymer is a lipohydrophilic glycerol-based polymer, as illustrated in FIG. 1, wherein: m, n, o, p, q and r are independently 0 to 700; R and R' are independently $—(CH_2)_x—$, wherein each x is independently 0 or 1; and each $R_1$ is independently selected from hydrogen, acyl and alkyl, wherein at least $R_1$ is alkyl.

The composition may be added to a papermaking process involving virgin pulp, recycled pulp or combination thereof at any one or more of various locations during the papermaking process. Suitable locations may include pulper, latency chest, reject refiner chest, disk filter or Decker feed or accept, whitewater system, pulp stock storage chests (either low density ("LD"), medium consistency (MC), or high consistency (HC)), blend chest, machine chest, headbox, saveall chest, paper machine whitewater system, and combinations thereof. The composition may be added to a pulp slurry in the papermaking process. The composition may also be applied to a surface in the papermaking process, such as a metal, plastic, or ceramic surfaces such as pipe walls, chest walls, machine wires, press rolls, felts, foils, Uhle boxes, dryers and any equipment surfaces that contact with fibers during the paper process. The method may include the step of contacting fibers with the composition. The fibers may be cellulose fibers, such as recycled fibers, virgin wood cellulose fibers, or combinations thereof.

In at least one embodiment, the composition is added to a papermaking process using recycled paper fibers. The recycled fibers may be obtained from a variety of paper products or fiber containing products, such as paperboard, newsprint, printing grades, sanitary and other paper products. These products may comprise, for example, old corrugated containers (OCC), old newsprint (ONP), mixed office waste (MOW), old magazines and books, or combinations thereof. These types of paper products typically contain large amounts of hydrophobic contaminants. In embodiments employing virgin fibers, the method may involve the use of pulp derived from softwood, hardwood or blends thereof. Virgin pulp can include bleached or unbleached Kraft, sulfite pulp or other chemical pulps, and groundwood (GW) or other mechanical pulps such as, for example, thermomechanical pulp (TMP).

Examples of organic hydrophobic contaminants include what is known in the industry as "stickies" that may include synthetic polymers resulting from adhesives and the like, glues, hot melts, coatings, coating binders, pressure sensitive binders, unpulped wet strength resins and "pitch" that may include wood resins, rosin and resin acid salts. These types of materials are typically found in paper containing products, such as newsprint, corrugated container, and/or mixed office waste. These hydrophobic contaminants can have polymers present, such as styrene butadiene rubber, vinyl acrylate polymers, polyisoprene, polybutadiene, natural rubber, ethyl vinyl acetate polymers, polyvinyl acetates, ethylvinyl alcohol polymers, polyvinyl alcohols, styrene acrylate polymers, and/or other synthetic type polymers.

The method may control hydrophobic contaminants in papermaking processes, e.g., the deposition of hydrophobic contaminants on components of a papermaking process. For example, the method may control hydrophobic contaminants present in paper mill furnish. For example, the method may reduce, inhibit or eliminate the deposition of hydrophobic contaminants in a papermaking process. The method may also reduce the size of contaminant particles through dispersion and suppressing agglomeration, and/or reduce the tackiness of the hydrophobic contaminants when compared to a papermaking process in which the composition is not employed. For example, the method may reduce the average size of contaminant particles by at least about 5% to about 40% (e.g., about 5%, 6%, 7%, 8%, 9%, 10%, 15%, 20%, 25%, 30%, 35% or 40%) when compared to a papermaking process in which the composition is not employed. In embodiments, the method may reduce the deposition of hydrophobic contaminants by at least about 5% to about 95% (e.g., about 5%, 6%, 7%, 8%, 9%, 10%, 15%, 20%, 25%, 30%, 35%, 40%, 45%, 50%, 55%, 60%, 65%, 70%, 75%, 80%, 85%, 90% or 95%) when compared to a papermaking process in which the composition is not employed.

In the method, the composition may be added to a papermaking process in an amount effective to reduce deposition of hydrophobic contaminants when compared to a papermaking process in which the composition is not employed. For example, the composition may be added to pulp slurry in an amount from about 10 ppm to about 300 ppm, e.g., from about 50 ppm to about 200 ppm, or about 50 ppm, 60 ppm, 70 ppm, 80 ppm, 90 ppm, 100 ppm, 110 ppm, 120 ppm, 130 ppm, 140 ppm, 150 ppm, 160 ppm, 170 ppm, 180 ppm, 190 ppm, to about 200 ppm. The effective amount may reduce the deposition of hydrophobic contaminants by at least 5% to about 95% (e.g., about 5%, 6%, 7%, 8%, 9%, 10%, 15%, 20%, 25%, 30%, 35%, 40%, 45%, 50° %, 55%, 60%, 65%, 70%, 75%, 80%, 85%, 90% or 95%) when compared to a papermaking process in which the composition is not employed. The method may further include adding to the papermaking system at least one component selected from the group consisting of fixatives, detackifiers and other dispersants.

In at least one embodiment the glycerol-based polymer may be any polymer containing repeating glycerol monomer units such as polyglycerols, polyglycerol derivatives, and polymers consisting of glycerol monomer units and at least one other monomer unit, regardless of the sequence of monomers unit arrangements. Suitably, other monomers may be polyols or hydrogen active compounds such as pentaerythrital, glycols, amines, etc. capable of reacting with glycerol or any polyglycerol structures. The polymer may be linear, branched, hyperbranched, cyclic, dendritic, and any combination thereof and have sub-chains/sunregions characterized by any combination thereof.

In at least one embodiment the glycerol-based polymer is branched. In at least one embodiment the branching structure in the backbone of the polymer, not in the lipophilic chains. In at least one embodiment the branched structure increases the polymer dimensions for the effective interfacial interactions to result in exceptional organic deposit control. Branching may be particularly useful as it facilitates increased molecular weight of the glycerol-based polymers. Branched polymers include both hyperbranched and dendritic structures. The branched, cyclic glycerol-based polymer may have a degree of branching of at least about 0.10, e.g., from about 0.20 to about 0.75 or from about 0.30 to about 0.50. For example, a branched, cyclic glycerol-based polymer may have a degree of branching of about 0.10, about 0.15, about 0.20, about 0.25, about 0.30, about 0.35, about 0.40, about 0.45, about 0.50, about 0.55, about 0.60, about 0.65, about 0.70 or about 0.75.

In at least one embodiment the glycerol-based polymer is cyclic, i.e. has at least one cyclic or ring structure, or has at least one cyclic or ring structured polymer molecule in the polymer. Such cyclic structures may be formed, for example, during the polymerization process via intramolecular cyclization reactions. The rigidity of cyclic structures in the polymer backbone may uniquely extend the molecular dimensions and increase the hydrodynamic volume, to better act interfacially for dispersing pitch and stickies. Cyclic glycerol-based polymers may have a degree of cyclization of about 0.01 to about 0.50. For example, the branched, cyclic glycerol-based polymer may have a degree of cyclization of at least 0.01, e.g., about 0.02 to about 0.19 or about 0.05 to about 0.15. For example, a branched, cyclic glycerol-based polymer may have a degree of cyclization of about 0.01, about 0.02, about 0.03, about 0.04, about 0.05, about 0.06, about 0.07, about 0.08, about 0.09, about 0.10, about 0.11, about 0.12, about 0.13, about 0.14, about 0.15, about 0.16, about 0.17, about 0.18, or about 0.19.

Suitable branched, cyclic glycerol-based polymers include compounds as illustrated in FIG. 1. In the these compounds, m, n, o, p, q and r are independently 0 to 700; R and R' are independently —$(CH_2)_x$—, wherein each x is independently 0 or 1; and each $R_1$ is independently selected from hydrogen, acyl, alkyl, acid and anionic groups. The anionic groups may be in acid form in acidic condition, in anionic salt form in neutral or basic condition or any combination thereof. The anionic group is selected from a list of phosphates —$P(O)(OH)_2$ or —$(CH_2)_xOP(O)(OH)_2$, phosphonates —$(CH_2)_xP(OXOH)_2$, carboxylates —$(CH_2C(O)OH$, sulfonates $(CH_2)_xS(O)_2OH$ and combination thereof, where per H can be independently substituted by any other groups or atoms, and each x can independently be any number of integers from 0 to 50. Furthermore, it should be understood that the compounds illustrated in FIG. 1 are random polymers of the indicated monomeric units, including $R_1$ groups. For example, in an exemplary embodiment in which m, n, o, p, q and r are each 1, it is understood that the monomeric units may be present in any order and not necessarily in the order illustrated in FIG. 1. In another exemplary embodiment in which m, n, o, p, q and r are each 2, it is understood that the monomeric units may be present in any order, where the two "m" units may or may not be adjacent to each other, the two "n" units may or may not be adjacent to each other, and so on. In another exemplary embodiment in which one $R_1$ is H, two $R_1$s are —$P(O)(OH)_2$ and another two R is are dodecanol, it is understood that any of the groups may or may not be on any of the end groups or non-end groups.

In embodiments of the formula illustrated in FIG. 1, each m, n, o and p is independently 1-700, and each q and r is independently 0-700. In embodiments of the formula illustrated in FIG. 1, each m, n, o and q is independently 1-700, and each p and r is independently 0-700. In embodiments of the formula illustrated in FIG. 1, each m, n, o, p, q and r is independently selected from 0 to 50, 0 to 40, 0 to 30 or 0 to 25. Suitably, each of m, n, o, p, q and r are independently selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50 (or more).

In embodiments of the formula illustrated in FIG. 1, each $R_1$ is independently selected from hydrogen, acyl and $C_1$-$C_{50}$ alkyl. When $R_1$ is alkyl, it may be, for example, a $C_1$-$C_{50}$ alkyl, $C_1$-$C_{40}$ alkyl, $C_1$-$C_{30}$ alkyl, $C_1$-$C_{24}$ alkyl, $C_6$-$C_{18}$ alkyl, $C_{10}$-$C_{16}$ alkyl or $C_{12}$-$C_{14}$ alkyl group. For example, each $R_1$ that is alkyl may independently be a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$ or $C_{24}$ alkyl group. The $R_1$ group may be optionally substituted with other hydrocarbon-based groups, such as branched, cyclic, saturated, or unsaturated groups.

When $R_1$ is acyl, it may be, for example, a C1-C15 acyl group. When $R_1$ is acyl, it may be, for example, —C(O)CH(OH)$CH_3$ (lactate). In embodiments, lactate or lactic acid may be produced as a co-product during the synthesis of the branched, cyclic glycerol-based polymer, which may further react with the polymer.

Figure 2:
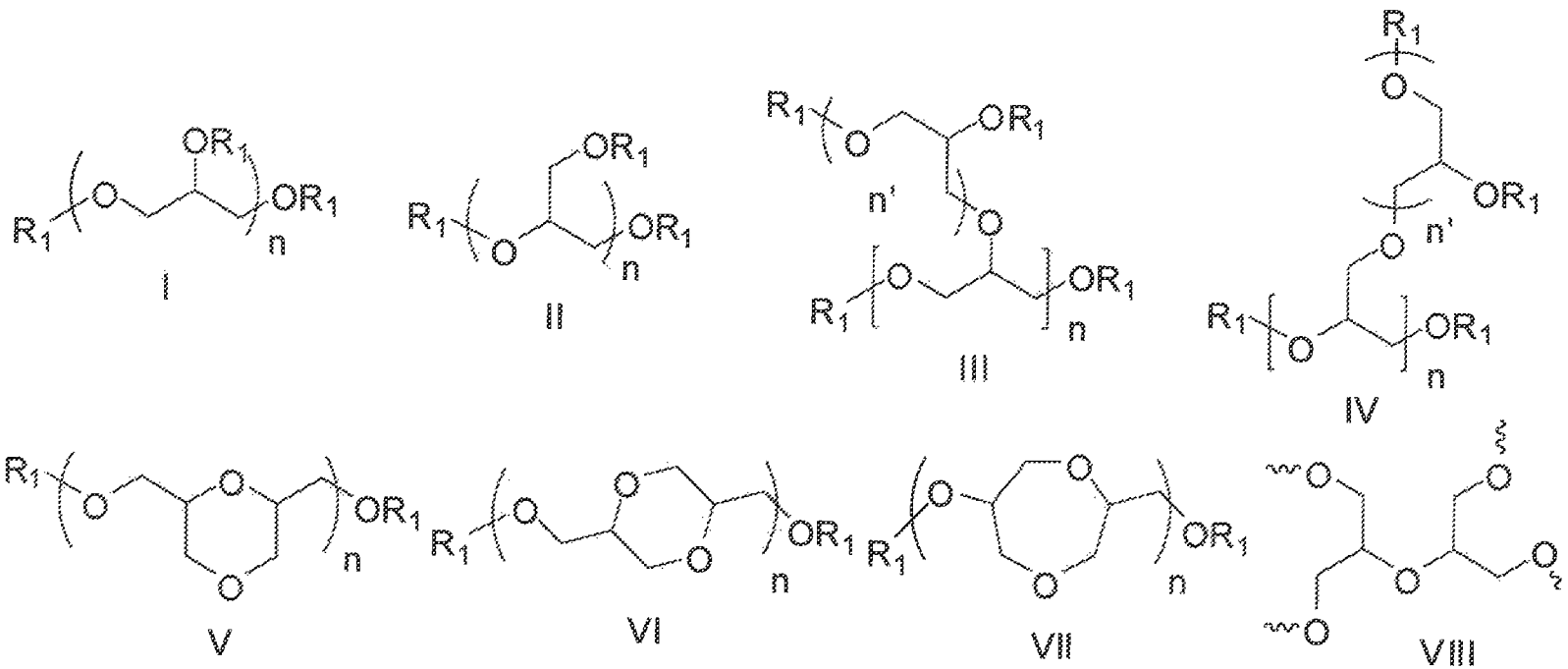
FIG. 2 is an illustration of a variety of glycerol based structural units which can be used to form the glycerol based polymer.

In at least one embodiment, the glycerol-based polymer may comprise at least two repeating units selected from at least one of the structures listed in FIG. 2, including but not limited to linear structures I and II, branched structures III, IV and VIII, cyclic structures V, VI and VII, and any combination thereof. Any structure in FIG. 2 can be combined with any structure or structures including itself, in any order. The cyclic linkages of any basic cyclic structures in FIG. 2 may contain any structure or structures as a part or parts of linkages. In each of the repeating units depicted in FIG. 2, each $R_1$ is independently selected from hydrogen, acyl, alkyl and anionic, and each n and n' is independently 0 to 700.

The glycerol-based polymer may have a weight-average molecular weight of about 100 Da to about 1,000,000 Da.

In at least one embodiment the glycerol-based polymer may be crosslinked. Crosslinked polymers include crosslinkages between one or more types of polymers which are: linear, branched, hyperbranched, cyclic, dendritic, and any combination thereof and have sub-chains/sub-regions characterized by any combination thereof. The glycerol-based polymer may self-crosslink, and/or the polymer may be crosslinked via addition of a crosslinking agent. Suitable crosslinking agents typically include at least two reactive groups such as double bonds, aldehydes, epoxides, halides, and the like. For example, a cross-linking agent may have at least two double bonds, a double bond and a reactive group, or two reactive groups. Non-limiting examples of such agents are diisocyanates, N,N-methylenebis(meth)acrylamide, polyethyleneglycol di(meth)acrylate, glycidyl(meth)acrylate, dialdehydes such as glyoxal, di- or tri-epoxy compounds such as glycerol diglycidyl ether and glycerol triglycidyl ether, dicarboxylic acids and anhydrides such as adipic acid, maleic acid, phthalic acid, maleic anhydride and succinic anhydride, phosphorus oxychloride, trimetaphosphates, dimethoxydimethsilane, tetraalkoxysilanes, 1,2-dichloroethane, 1,2-dibromoethane, dichloroglycerols 2,4,6-trichloro-s-triazine and epichlorohydrin.

The glycerol-based polymer used for the anionic and lipophilic modifications may be from a commercially available supplier, or synthesized according to known methods such as those described in U.S. Pat. Nos. 3,637,774, 5,198,532 and 6,765,082 B2, and in U.S. Patent Application Publication Nos. 2008/0306211 and 2011/0092743, or from any combination thereof.

For example, in embodiments, a method of preparing a glycerol-based polymer for the modifications may include the step of: reacting a reaction mass comprising at least glycerol monomer in the presence of a strong base catalyst of a concentration above 2%, in a low reactivity atmospheric environment at a temperature above 200° C., which produces a product comprising branched, cyclic polyols and a co-product comprising lactic acid, lactic salt, and any combination thereof. Such a method can further comprise the steps of providing a catalyst above 3%. The catalyst may be selected from the group consisting of: NaOH, KOH, CsOH, a base stronger than NaOH, and any combination thereof. The strong base catalyst in the particular amount can be used with combining a base weaker than NaOH. The atmospheric environment may be an atmospheric pressure of less than 760 mm Hg and/or may be a flow of an inert gas selected from the list of $N_2$, $CO_2$, He, other inert gases and any combination thereof and the flow is at a rate of 0.2 to 15 mol of inert gas per hour per mol of monomer. The particular atmospheric environment profile applied can be steady, gradual increase, gradual decrease or any combination thereof.

The method of preparing the branched, cyclic glycerol-based polymer may produce glycerol-based polymer products selected from the group consisting of polyglycerols, polyglycerol derivatives, a polyol having both glycerol monomer units and non-glycerol monomer units and any combination thereof. The branched, cyclic glycerol-based polymer products have at least two hydroxyl groups. At least a portion of the produced polymers may have both at least a 0.1 degree of branching and at least a 0.01 degree of cyclization. The co-product may be at least 1% by weight.

The method of preparing the branched, cyclic glycerol-based polymer may make use of different forms of glycerol including pure, technical, crude, or any combination thereof. Such methods may further comprise other monomers selected from the group consisting of polyols such as pentaerythritol and glycols, amines, other monomers capable of reacting with glycerol or glycerol-based polyol intermediates and any combination thereof. The monomer(s) and/or catalyst(s) can be mixed at the very beginning of the reaction, at any time during the reaction and any combination thereof. The glycerol-based polyol products may be resistant to biological contamination for at least two years after synthesis. The method may further comprise the steps of pre-determining the desired molecular weight of the produced polyglycerol and adjusting the atmospheric environment to match the environment optimum for producing the desired molecular weight. The method may further comprise the steps of pre-determining the desired degree of branching and the desired degree of cyclization of the produced polyglycerol and the desired amount of co-product, and adjusting the atmospheric environment to match the environment optimum for producing the desired degree of branching, degree of cyclization and amount of co-product lactic acid and/or lactate salt.

Anionic, lipophilic glycerol-based polymer may be made from a lipophilic glycerol-based polymer. The lipohydrophilic glycerol-based polymer may be produced from glycerol-based polymers, such as those that are commercially available or those described herein, according to known methods such as alkylation, esterification and any combinations thereof. For example, such polymers may be produced from glycerol-based polymers according to known methods such as alkylation, as described in German Patent Application No. 10307172, in Canadian Patent No. 2,613,704, in U.S. Pat. Nos. 3,637,774, 5,198,532, 6,228,416 and 6,765,082 B2, in U.S. Patent Application Publication Nos. 2008/0306211 and 2011/0220307, in Markova et al. Polymer International, 2003, 52, 1600-1604, and the like. The glycerol-based polymers may be produced according to known methods such as esterification of glycerol-based polymers as described in U.S. Pat. No. 2,023,388, U.S. Patent Application Publication No. 2006/0286052 and the like. The esterification may be carried out with or without a catalyst such as acid(s) or base(s).

Anionic, lipophilic glycerol-based polymers may be made from crosslinked polymers. The crosslinked glycerol-based polymers may be produced in a continuous process under a low reactivity atmospheric environment according to a method described in U.S. patent application Ser. No. 13/484,526, filed on May 31, 2012. The method may comprise the steps of: a) reacting a reaction mass comprising at least glycerol monomer in the presence of a strong base catalyst of a concentration of above 2% at a temperature above 200 degrees C. which produces a first product comprising polyols which are both branched and cyclic, and a co-product comprising lactic acid, lactic salt, and any combination thereof, b) esterifying the first product in presence of an acid catalyst of a concentration above 5% at a temperature above 115 degrees C. to produce a second product, c) alkylating the second product at a temperature above 115 degrees C. to form a third product, and d) crosslinking the third product at a temperature above 115 degrees C. to form an end product. The resulting polymer may further react with the acid catalyst to form the desired anionic polymer.

EXAMPLES

The foregoing may be better understood by reference to the following examples, which is presented for purposes of illustration and is not intended to limit the scope of the invention.

Example 1

Synthesis of Polyglycerols

100 Units (or using different amounts) of glycerol were added to a reaction vessel followed by 3.0 to 4.0% of active NaOH relative to the reaction mixture. This mixture was agitated and then gradually heated up to 240° C. under a particular low reactivity atmospheric environment of nitrogen flow rate of 0.2 to 4 mol of nitrogen gas per hour per mol of monomer. This temperature was sustained for at least three hours to achieve the desired polyglycerol compositions, while being agitated under a particular low reactivity atmospheric environment. An in-process polyglycerol sample was drawn before next step for the molecular weight/composition analysis/performance test. For the performance test, the polyglycerol was dissolved in water as 50% product. The analysis of polyglycerols (PG) is summarized in Table 1.

TABLE 1

Composition of polyglycerols

| Polylgycerol | MW | DB | Lactic acid by wt. relative to PG | Notes |
|---|---|---|---|---|
| PG1 | 9,300 | 0.34 | 15% | Used for performance test |
| PG2 | 320 | 0.24 | 9% | Used for synthesis of ALPG |

Example 2

Synthesis of Anionic, Lipophilic Polyglycerol (ALPG)

To a reaction vessel with 100 units of polyglycerol (PG2) was added polyphosphoric acid (116.2% by wt. relative to polylgycerol). The mixture was gradually heated to 130° C. under nitrogen atmosphere while agitating whenever stirrable, and kept at this condition for hours to achieve the desired phosphorylation. After cooling down 1-hexanol (31.9% by wt. relative to polyglycerol) was added. The mixture was gradually heated to 150° C. under nitrogen atmosphere while stirring, and kept at this condition for hours to result in the final composition. The ALPG was dissolved in water as 60% product.

Example 3

Performance Test

For the organic deposition control experiment, file fold label (TopStick 4282) is used as adhesives, and baffle test method is used to evaluate the effectiveness of chemistry by deposition mass comparing to that of a blank test.

The topstick label (12.4 cm×21.0 cm) is placed on a plain copy paper, and the paper with the adhesives is cut or torn into 2.5 cm square pieces and put in a disintegrator vessel. Plain copy paper without adhesives is also cut or torn in 2.5 cm square pieces and added to the disintegrator vessel to make up 18.75 g of paper material in total. To the disintegrator vessel, hot water is added to a total weight of 1875 g of the suspension, and the suspension is mechanically disintegrated for 30 minutes to result in pulp of 1% consistency. The pulp is transferred to the baffle testing vessel, and diluted with 1875 g of hot water, followed by mixing to form the pulp in 0.5% consistency for the test. The baffle testing vessel is heated on a hot plant and controlled at 50° C. while mixing at 425 rpm. After 60 minutes at this temperature, the baffles (plastic strips) are removed, rinsed with cooled water and finally air dried. The weight increase of strips is the deposition mass of the blank test, which is without addition of any chemicals.

For evaluation of chemistry, a chemical sample or product is added before heated to the testing temperature 50° C. in the baffle test, and the deposition control effectiveness is calculated by the deposition mass difference from the blank divided by the deposition mass of the blank.

Figure 3:
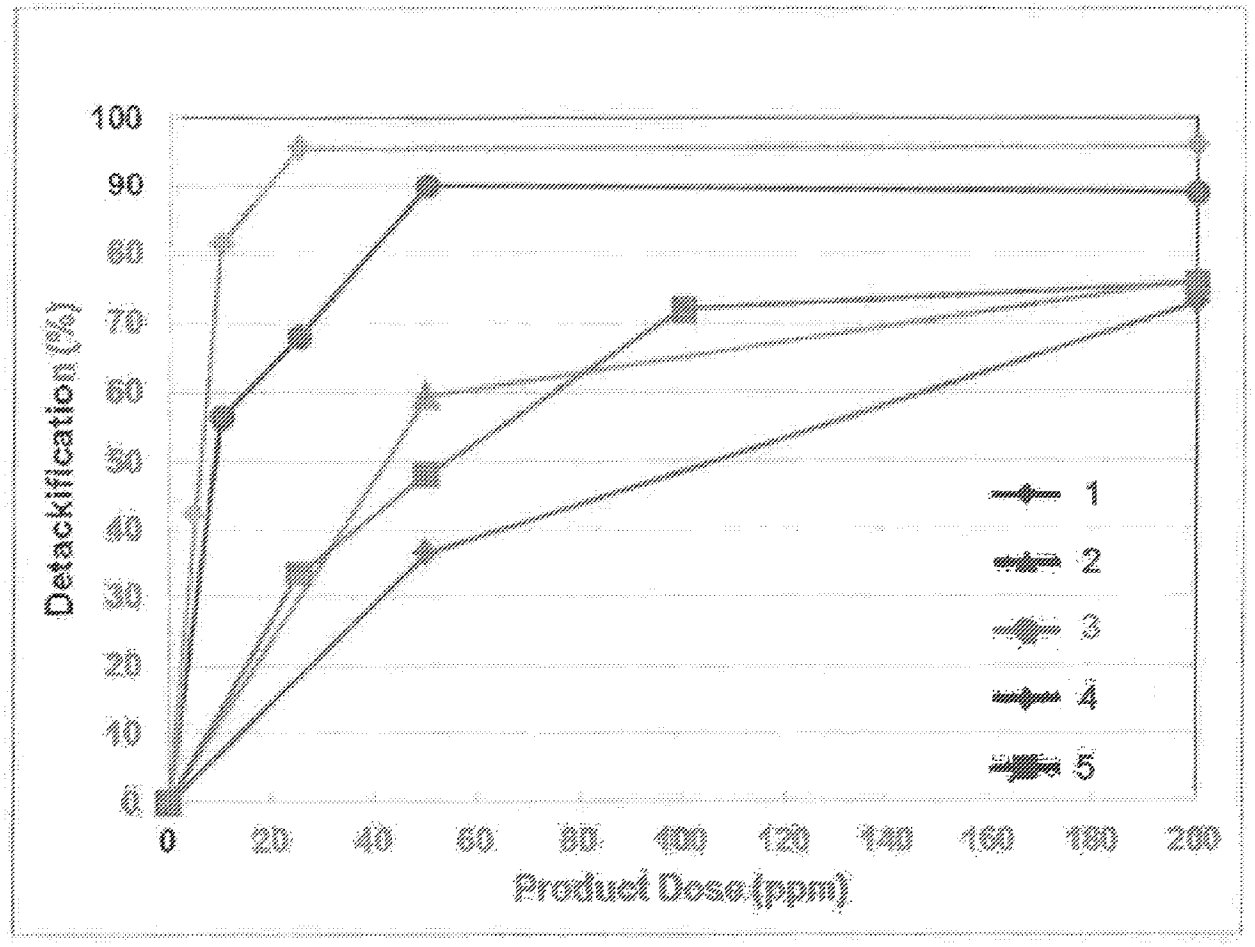
FIG. 3 is a graph which demonstrates the effectiveness of the invention.

FIG. 3 graphically conveys the effectiveness of the invention (ALPG) as a superior detackifier of organic contaminants comparing to non-modified glycerol based polymer PG1 and a Nalco current product 64231 (a copolymer of vinyl alcohol and vinyl acetate).

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or more of the various embodiments described herein and/or incorporated herein.

The above disclosure is intended to be illustrative and not exhaustive. This description will suggest many variations and alternatives to one of ordinary skill in this art. The compositions and methods disclosed herein may comprise, consist of, or consist essentially of the listed components, or steps. As used herein the term "comprising" means "including, but not limited to". As used herein the term "consisting essentially of" refers to a composition or method that includes the disclosed components or steps, and any other components or steps that do not materially affect the novel and basic characteristics of the compositions or methods. For example, compositions that consist essentially of listed ingredients do not contain additional ingredients that would affect the properties of those compositions. Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Weight percent, percent by weight, % by weight, wt %, and the like are synonyms that refer to the concentration of a substance as the weight of that substance divided by the weight of the composition and multiplied by 100. All percentages and ratios are by weight unless otherwise stated.

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of reducing the deposition of organic contaminants in papermaking processes, comprising adding to pulp or a papermaking system an effective amount of a composition comprising an anionic lipophilic branched, cyclic glycerol-based polymer, wherein the composition selectively bonds with the organic contaminants to form a complex and the complex is stable in papermaking processes.

2. The method of claim 1, wherein the glycerol-based polymer is modified with an anionic group selected from the list consisting of phosphates, phosphonates, carboxylates, sulfonates, the like and any combination thereof.

3. The method of claim 1, wherein the glycerol-based polymer is an anionic lipohydrophilic glycerol based polymer.

4. The method of claim 1, wherein the glycerol-based polymer is branched, hyperbranched, dendritic, or any combination thereof.

5. The method of claim 1, wherein the branched, cyclic glycerol-based polymer is cross-linked.

6. The method of claim 1, wherein the anionic branched, cyclic glycerol-based polymer is a random polymer of the monomeric units including $R_1$ indicated in the following formula:

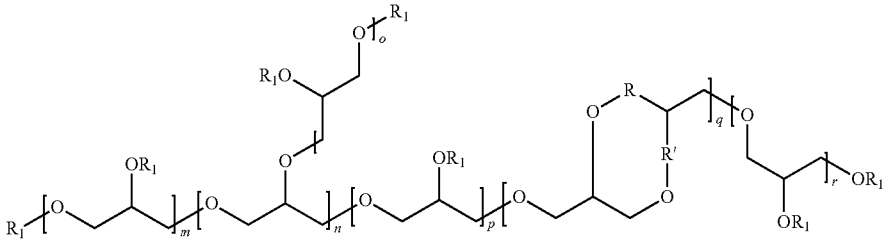

wherein:

m, n, o, p, q and r are independently 0 to 700;

R and R' are independently —$(CH_2)_x$—, wherein each x is independently 0 or 1; and each $R_1$ is independently selected from hydrogen, acyl, $C_1$-$C_{50}$ alkyl and anionic groups.

7. The method of claim 6, wherein each $R_1$ is independently selected from hydrogen, $C_2$-$C_{18}$ alkyl, and —C(O)CH(OH)$CH_3$.

8. The method of claim 6, wherein m, n, o, p, q and r are independently selected from 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50.

9. The method of claim 1, wherein the glycerol-based polymer has a weight-average molecular weight of about 200 Da to about 500,000 Da.

10. The method of claim 1, further comprising adding to the pulp or the papermaking system at least one component selected from the group consisting of fixatives, dispersants, and other detackifiers.

11. The method of claim 1, wherein the organic contaminants are stickies.

12. The method of claim 1, wherein the organic contaminants are pitch, stickies or combination thereof.

13. The method of claim 1, wherein the composition is added to a pulp slurry in a pulper, latency chest, reject refiner chest, disk filter or Decker feed or accept, whitewater system, pulp stock storage chest, blend chest, machine chest, headbox, saveall chest, or any combination thereof in the papermaking process.

14. The method of claim 1, wherein the composition is added to a surface in the papermaking process selected from a pipe wall, a chest wall, a machine wire, a press roll, a felt, a foil, an Uhle box, a dryer, or any combination thereof.

15. The method of claim 1, wherein the anionic branched, cyclic glycerol-based polymer is added to a pulp slurry in the papermaking process.

16. The method of claim 1, wherein the effective amount of the anionic branched, cyclic glycerol-based polymer is from about 5 ppm to about 300 ppm.

* * * * *